US011137711B2

(12) United States Patent
Teramoto

(10) Patent No.: US 11,137,711 B2
(45) Date of Patent: Oct. 5, 2021

(54) IMAGE FORMING APPARATUS

(71) Applicant: CANON KABUSHIKI KAISHA, Tokyo (JP)

(72) Inventor: Hironobu Teramoto, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/803,132

(22) Filed: Feb. 27, 2020

(65) Prior Publication Data

US 2020/0285189 A1 Sep. 10, 2020

(30) Foreign Application Priority Data

Mar. 4, 2019 (JP) ..... JP2019-038242

(51) Int. Cl.
*G03G 15/00* (2006.01)
*G03G 15/20* (2006.01)

(52) U.S. Cl.
CPC ..... *G03G 15/80* (2013.01); *G03G 15/2053* (2013.01)

(58) Field of Classification Search
None
See application file for complete search history.

(56) References Cited

U.S. PATENT DOCUMENTS

2008/0095552 A1* 4/2008 Aiba ..... G03G 15/80 399/90

FOREIGN PATENT DOCUMENTS

JP 2008010375 A 1/2008

* cited by examiner

*Primary Examiner* — Jas A Sanghera
(74) *Attorney, Agent, or Firm* — Rossi, Kimms & McDowell LLP

(57) ABSTRACT

An image forming apparatus includes a first circuit board provided with a first connector, a second circuit board provided with a second connector, and a plurality of electric wires one-end portions of which a first connector housing including a plurality of pins is connected to and other-end portions of which a second connector housing including a plurality of pins is connected to. An alignment direction of the plurality of pins of the first connector housing differs from an alignment direction of the plurality of pins of the second connector housing, and the plurality of electric wires have lengths different from one another.

18 Claims, 4 Drawing Sheets

IMAGE FORMING APPARATUS

BACKGROUND OF THE INVENTION

Field of the Invention

The present invention relates to an image forming apparatus including a heater.

Description of the Related Art

An image forming apparatus includes a fixing device including a fixing heater as a heat source. The fixing device is connected to an AC power source via an AC circuit board including a control circuit including a switching element, such as a triac, and the AC power source supplies the fixing device with electric power. The electric power from the AC power source is converted in a power source circuit board into DC low voltage. The conversion is intended to supply an engine, a controller, a motor, and other loads with predetermined DC voltage. Since the electric power from the AC power source is supplied to the AC circuit board, the electric power from the AC power source is therefore typically to the power source circuit board via the AC circuit board. Further, the low voltage converted in the power source circuit board is distributed to the engine, the controller, the motor, and the other loads via a distribution circuit in the AC circuit board. From a viewpoint of reduction in size of an image forming apparatus in recent years, the AC circuit board and the power source circuit board are required to be arranged as closely as possible. In association with the requirement described above, a wire harness (hereinafter referred to as electric wire bundle) that bundles a plurality of electric wires that connect the AC circuit board to the power source circuit board is also required to be shortened.

Connector housings are provided at opposite end portions of the electric wire bundle, which connects the AC circuit board to the power source circuit board. The connector housings are typically connected to the electric wire bundle as follows: Insulating coatings on opposite end portions of each of the plurality of electric wires in the electric wire bundle are first removed. Crimp terminals (contact pins) are crimped to the electric wires at the opposite end portions where the insulating coatings have been removed. The crimp terminals are inserted into insertion portions of the connector housings. The connector housings each have a plurality of pins. The crimp terminals are so inserted into the connector housings by wire that a pin of one of the connector housings is connected to the same-numbered pin of the other connector housing (pins 1 are connected to each other, pins 2 are connected to each other, for example). The plurality of electric wires in the electric wire bundle are each characterized by a large diameter and high stiffness. The reason why the electric wires each have a large diameter (outer diameter of coating) is that large current flows through the electric wires that connect the AC circuit board to the power source circuit board.

In the thus characterized electric wire bundle, when the plurality of electric wires are twisted and routed, large stress is induced in each of the electric wires and crimp terminals, resulting in possible problems of deterioration in workability and falling off of the crimp terminals from the insertion portions. Japanese Patent Application Laid-Open No. 2008-10375 discloses a technology for reducing stress induced in an electric wire bundle. Japanese Patent Application Laid-Open No. 2008-10375 proposes a technology for removing insulating coatings on opposite end portions of each of the electric wires, causing first and second terminals to be oriented in opposite directions in the upward/downward direction, crimping the first and second terminals to the opposite end portions of the electric wire, and inserting the terminals into insertion portions of connector housings. The procedure described above causes no twist of electric wires, so that the electric wires can be readily and flexibly curved with high elasticity, whereby the workability is improved.

The related-art technology disclosed in Japanese Patent Application Laid-Open No. 2008-10375, however, has a problem of stress induced in the electric wires and the terminals because the electric wires intersect each other. In particular, since the electric wires that connect the AC circuit board to the power source circuit board each have a diameter (outer diameter of coating) according to allowable current, the magnitude of the stress induced in the electric wires and the terminals is likely to increase when the electric wire bundle is curved.

SUMMARY OF THE INVENTION

An object of the present invention is therefore to reduce stress induced in a plurality of electric wires including crimp terminals for connecting a circuit board connected to an AC power source to apply AC voltage to a heater and a circuit board that converts the AC voltage supplied from the AC power source via the circuit board connected to the AC power source into DC voltage.

To achieve the object described above, an image forming apparatus according to an embodiment of the invention comprises an image forming unit configured to form an image on a sheet; a heater configured to fix the image onto the sheet; a first circuit board which is provided with a first connector including a plurality of pins, and configured to apply AC voltage supplied from a commercial power source to the heater; a second circuit board which is provided with a second connector including a plurality of pins, and configured to convert the AC voltage into DC voltage to supply the DC voltage to the image forming unit; a plurality of electric wires; first crimp terminals which are provided with one-end portions of the plurality of electric wires; second crimp terminals which are provided with other-end portions of the plurality of electric wires; a first connector housing into which the first crimp terminals at the one-end portions are inserted, wherein the first connector housing and the first connector are detachably connecting; and a second connector housing into which the second crimp terminals at the other-end portions are inserted, wherein the second connector housing and the second connector are detachably connecting, wherein an alignment direction of the plurality of pins of the first connector housing differs from an alignment direction of the plurality of pins of the second connector housing, and wherein the plurality of electric wires have lengths different from one another.

Further features of the present invention will become apparent from the following description of exemplary embodiments with reference to the attached drawings.

DESCRIPTION OF THE EMBODIMENTS

First Embodiment

A first embodiment will be described below with reference to the drawings.

(Image Forming Apparatus)

Figure 1:
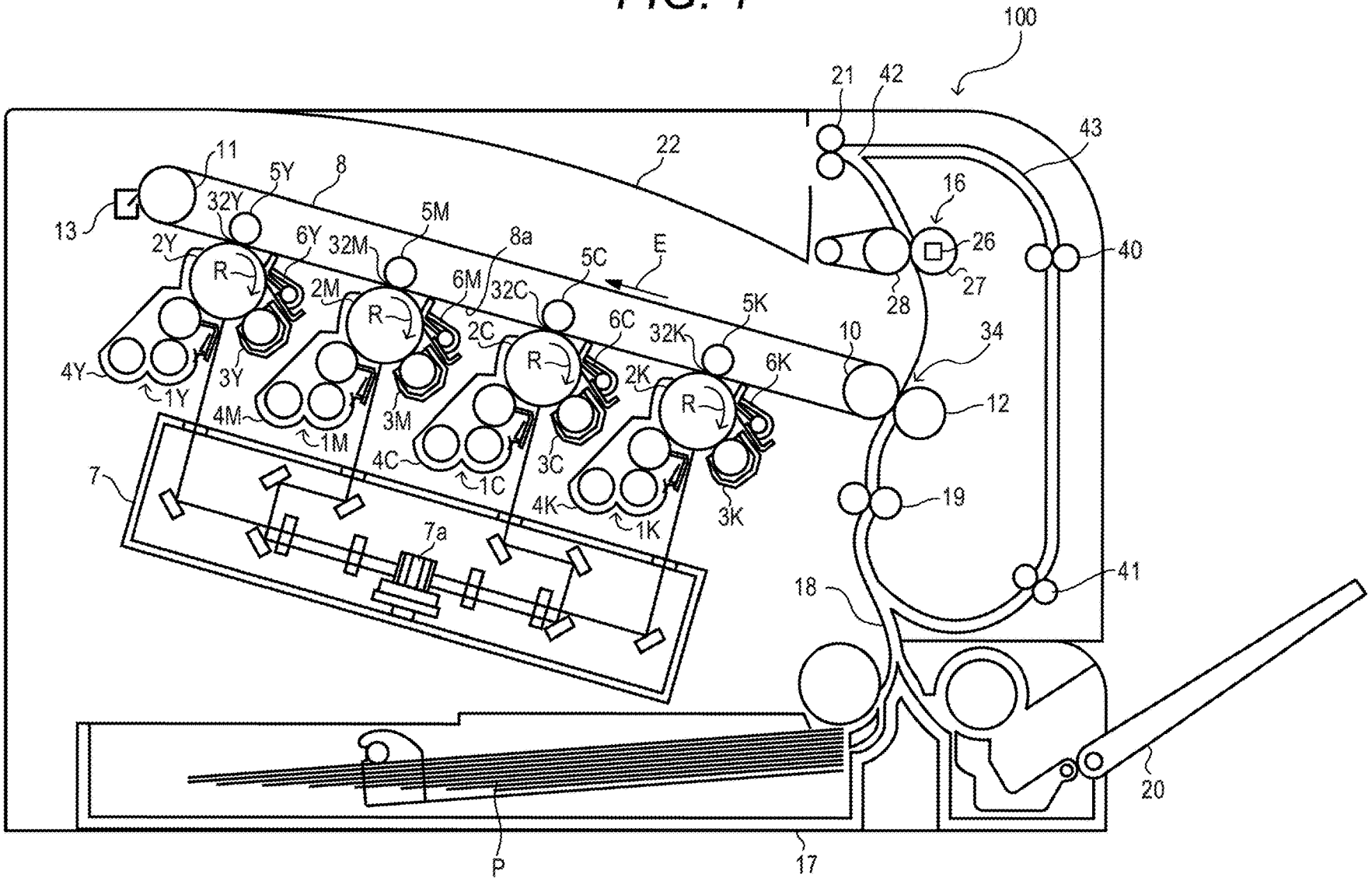
FIG. 1 is a cross-sectional view of an image forming apparatus.

FIG. 1 is a cross-sectional view of an image forming apparatus 100. The image forming apparatus 100 is a full-color laser beam printer that forms an image on a recording medium (hereinafter referred to as sheet) P by using an electrographic image formation process. The image forming apparatus 100 may instead be a digital copier, a color LED printer, a multifunctional printer (MFP), a facsimile apparatus, or a printing machine. The image forming apparatus 100 is not limited to an image forming apparatus that forms a color image and may instead be an image forming apparatus that forms a monochrome image. Examples of the sheet P include a plane sheet, a thin sheet, a thick sheet, a special sheet (embossed sheet, coated sheet), a sheet made of an arbitrary material, such as plastic film for overhead projector and fabric, and a sheet having an arbitrary shape, such as an envelope and an index sheet.

The image forming apparatus 100 includes four image forming portions (image forming units) 1 (1Y, 1M, 1C, and 1K). The image forming portion 1Y forms a yellow image. The image forming portion 1M forms a magenta image. The image forming portion 1C forms a cyan image. The image forming portion 1K forms a black image. The four image forming portions 1Y, 1M, 1C and 1K are arranged in a single row at fixed intervals. The suffixes Y, M, C and K to a reference character represent yellow, magenta, cyan, and black, respectively. In the following description, the suffixes Y, M, C and K to a reference character are omitted in some cases when not particularly required. The four image forming portions 1Y, 1M, 1C and 1K have the same structure except the colors of developing agents (tonners).

The four image forming portions 1Y, 1M, 1C and 1K are provided with drum-shaped electrophotographic photosensitive members (hereinafter referred to as photosensitive drums) 2Y, 2M, 2C and 2K, respectively, which each serve as an image carrier. The photosensitive drums 2Y, 2M, 2C and 2K have the following components therearound: chargers 3Y, 3M, 3C and 3K; developing devices 4Y, 4M, 4C and 4K; transfer rollers 5Y, 5M, 5C and 5K; and drum cleaners 6Y, 6M, 6C and 6K, respectively. A laser exposure apparatus 7 including a light source is disposed below the photosensitive drums 2Y, 2M, 2C and 2K. The laser exposure apparatus 7 is so controlled as to emit laser light based on image signals corresponding to the four colors. The surfaces of the photosensitive drums 2Y, 2M, 2C and 2K are irradiated with the laser light from the laser exposure apparatus 7 through the gaps between the chargers 3Y, 3M, 3C, 3K and the developing devices 4Y, 4M, 4C, 4K.

The photosensitive drums 2Y, 2M, 2C and 2K are each a negatively charged OPC photosensitive member. The photosensitive drums 2Y, 2M, 2C and 2K each include an aluminum drum base and a photoconductive layer formed on the drum base. The photosensitive drums 2Y, 2M, 2C and 2K are each rotated by a motor (not shown) at a predetermined rotary speed in the direction indicated by the arrows R (clockwise in FIG. 1). The chargers 3Y, 3M, 3C and 3K applies charging bias applied from a charging bias power source (not shown) to uniformly charge the surfaces of the photosensitive drums 2Y, 2M, 2C and 2K in such a way that the surfaces have negative-polarity predetermined potential. The developing devices 4Y, 4M, 4C and 4K store a yellow toner, a magenta tonner, a cyan tonner, and a black tonner, respectively. The developing devices 4Y, 4M, 4C and 4K cause the color tonners to adhere to electrostatic latent images formed on the photosensitive drums 2Y, 2M, 2C and 2K to develop (visualize) tonner images. The transfer rollers 5Y, 5M, 5C and 5D press an intermediate transfer belt 8 against the photosensitive drums 2Y, 2M, 2C and 2K to form primary transfer nips 32Y, 32M, 32C and 32K. The drum cleaners 6Y, 6M, 6C and 6K include cleaning blades for removing tonners left on the photosensitive drums 2Y, 2M, 2C and 2K after the primary transfer from the photosensitive drums 2Y, 2M, 2C and 2K.

The intermediate transfer belt 8 is an endless belt disposed above the photosensitive drums 2Y, 2M, 2C and 2K. The intermediate transfer belt 8 extend between a secondary transfer facing roller 10 and a tension roller 11 and is stretched by the two rollers. The intermediate transfer belt 8 is rotated in the direction indicated by the arrow E (counterclockwise in FIG. 1). The secondary transfer facing roller 10 presses the intermediate transfer belt 8 against a secondary transfer roller 12 to form a secondary transfer nip 34. The secondary transfer facing roller 10 imparts drive force to the intermediate transfer belt 8. The tension roller 11 imparts tension to the intermediate transfer belt 8. The intermediate transfer belt 8 is made of a dielectric resin, such as polycarbonate, polyethylene terephthalate resin film, and polyvinylidene fluoride resin film. The intermediate transfer belt 8 is so disposed that a primary transfer surface (lower flat surface) 8*a*, which faces the photosensitive drums 2Y, 2M, 2C and 2K, inclines in such a way that a side of the intermediate transfer belt 8 that is the side facing the secondary transfer roller 12 is lower than the other side. That is, the intermediate transfer belt 8 is so disposed as to be movable and face the upper surfaces of the photosensitive drums 2Y, 2M, 2C and 2K and further so disposed that a primary transfer surface 8*a*, which faces the photosensitive drums 2Y, 2M, 2C and 2K, inclines in such a way that a side of the intermediate transfer belt 8 that is the side facing the secondary transfer nip 34 is lower than the other side. A belt cleaner 13, which removes and recovers tonners left on the surface of the intermediate transfer belt 8 after the secondary transfer, is provided in a position outside the intermediate transfer belt 8 that is a position in the vicinity of the tension roller 11.

The laser exposure apparatus 7 includes a laser light emitting element that outputs the laser light according to time-series digital signals input as the image signals, a polygonal mirror 7*a*, lenses, and reflection mirrors. The laser exposure apparatus 7 outputs the laser light according to data on images corresponding to the four colors to the surfaces of the photosensitive drums 2Y, 2M, 2C and 2K having been uniformly charged by the chargers 3Y, 3M, 3C and 3K to form electrostatic latent images on the surfaces of the photosensitive drums 2Y, 2M, 2C and 2K. The fixing device 16 as a fixing unit is disposed on the downstream of the secondary transfer nip 34 in the direction in which the sheet P is transported. The fixing device 16 includes a heating roller 27, which includes a heater 26 for heating the tonner images on the sheet P, and a pressuring roller 28, which presses the heating roller 27. AC voltage is applied to the heater 26. The amount of heat generated by the heater 26 is controlled based on the AC voltage.

(Image Forming Operation)

Image forming operation performed by the image forming apparatus 100 will next be described. When an image formation start signal is issued, the photosensitive drums 2Y, 2M, 2C and 2K are rotated in the direction indicated by the arrows R, and the intermediate transfer belt 8 is rotated in the direction indicated by the arrow E. The chargers 3Y, 3M, 3C and 3K uniformly charges the surfaces of the photosensitive drums 2Y, 2M, 2C and 2K rotated at the predetermined rotary speed in such a way that the surfaces have the negative polarity. The laser exposure apparatus 7 causes the laser light emitting element to output the laser light according to externally input image signals carrying separated colors. The laser light travels via the polygonal mirror 7*a*, the lenses, and the reflection mirrors, and the uniformly charged surfaces of the photosensitive drums 2Y, 2M, 2C and 2K are irradiated with the laser light. Electrostatic latent images forms based on the image signals corresponding to the four colors are thus formed.

First, in the image forming portion 1Y, the developer 4Y to which developing bias having the same polarity as the charging polarity (negative polarity) of the photosensitive drum 2Y is applied causes the yellow tonner to adhere to the electrostatic latent image formed on the photosensitive drum 2Y, whereby the electrostatic latent image is visualized as a yellow tonner image. The yellow tonner image is transferred at the primary transfer nip 32Y between the photosensitive drum 2Y and the transfer roller 5Y onto the intermediate transfer belt 8 by the transfer roller 5Y to which primary transfer bias (having polarity opposite the polarity of tonner (positive polarity)) has been applied. The yellow tonner image transferred onto the intermediate transfer belt 8 is moved to the image forming portion 1M. Also in the image forming portion 1M, a magenta tonner image is similarly formed on the surface of the photosensitive drum 2M. The magenta tonner image is so transferred at the primary transfer nip 32M as to be superimposed on the yellow tonner image on the intermediate transfer belt 8. Thereafter, a cyan tonner image and a black tonner image are similarly formed on the surfaces of the photosensitive drums 2C and 2K in the image forming portions 1C and 1K, respectively. The cyan and black tonner images are so transferred at the primary transfer nips 32C and 32K as to be sequentially superimposed on the yellow and magenta tonner images so transferred on the intermediate transfer belt 8 as to be superimposed on each other. A full-color tonner image is thus formed on the intermediate transfer belt 8. Tonners left on the surfaces of the photosensitive drums 2Y, 2M, 2C and 2K after the primary transfer are scraped off the drums by the cleaner blades provided in the drum cleaners 6Y, 6M, 6C and 6K and recovered.

On the other hand, the sheet P is delivered from a feeding cassette 17 or a manual feeder 20 to registration rollers 19 along a transport path 18. The registration rollers 19 transport the sheet P to the secondary transfer nip 34 in such a way that the front end of the sheet P coincides with the front end of the tonner images on the intermediate transfer belt 8 at the secondary transfer nip 34. At the secondary transfer nip 34, the tonner images are collectively transferred onto the sheet P by secondary transfer roller 12 to which the secondary transfer bias (having polarity opposite the polarity of tonner (positive polarity)). The sheet P on which the tonner images have been transferred is transported to the fixing device 16. The fixing device 16 heats and pressurizes the tonner images to thermally fix the tonner images onto the surface of the sheet P. An image is thus formed on the sheet P. The sheet P on which the image has been formed is ejected by ejection rollers 21 onto an ejection tray 22 provided at the upper surface of the main body of the image forming apparatus 100. Tonners left on the intermediate transfer belt 8 after the secondary transfer are removed and recovered by the belt cleaner 13. The series of image forming operation performed in the single-side printing thus ends.

Image forming operation performed by the image forming apparatus 100 in double-side printing will next be described. The tonner images are transferred onto the surface of the sheet P, and the sheet P is transported to the fixing device 16, as in the image forming operation in the single-side printing. After the fixing device 16 heats, pressurizes, and thermally fixes the tonner images onto the surface of the sheet P, the ejection rollers 21 ejects the sheet P but stops rotating with the majority of the sheet P ejected by the ejection roller 21 onto the ejection tray 22. At this point, the ejection rollers 21 stops rotating when the position of the rear end of the sheet P reaches a reverse movement allowable position 42. The ejection rollers 21 are then rotated in the reverse direction to transport the sheet P located in the reverse movement allowable position 42 to a double-side path 43, which is provided with double-side rollers 40 and 41, with the rear end of the sheet P transported as the front end.

When the sheet P reaches the double-side rollers 40, the double-side rollers 40 transport the sheet P to the double-side rollers 41. The double-side rollers 41 then transport the sheet P to the registration rollers 19. During the transportation, the image formation start signal that starts image formation on the rear surface of the sheet P is issued, and tonner images are formed on the intermediate transfer belt 8, as in the single-side image formation. The registration rollers 19 transport the sheet P to the secondary transfer nip 34 in such a way that the front end of the sheet P coincides with the front end of the tonner images on the intermediate transfer belt 8 at the secondary transfer nip 34. At the secondary transfer nip 34, the tonner images are collectively transferred onto the rear surface of the sheet P. The fixing device 16 fixes the tonner images transferred onto the rear surface of the sheet P. The sheet P on which the images have been formed on opposite sides is ejected by the ejection rollers 21 onto the ejection tray 22. The series of image forming operation performed in the double-side printing thus ends.

(Circuit Boards and Electric Wire Bundle)

Figure 2A:
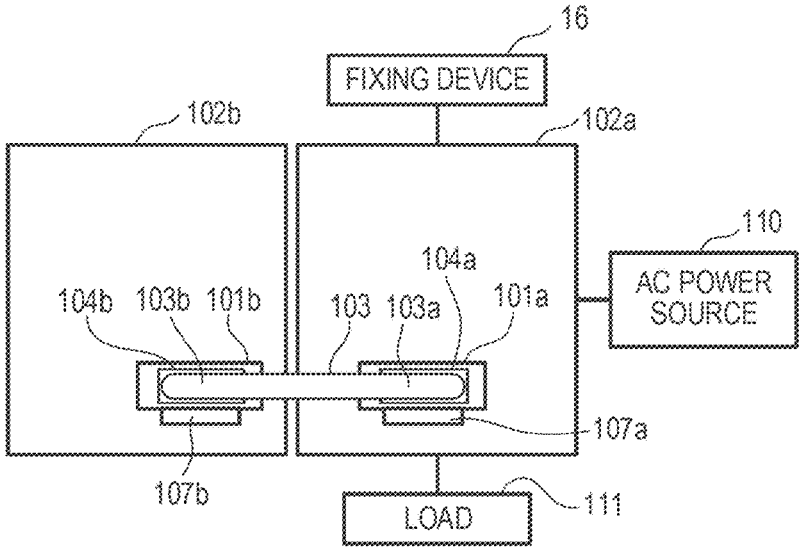
FIGS. 2A, 2B and 2C illustrate circuit boards and an electric wire bundle according to a first embodiment.
Figure 2B:
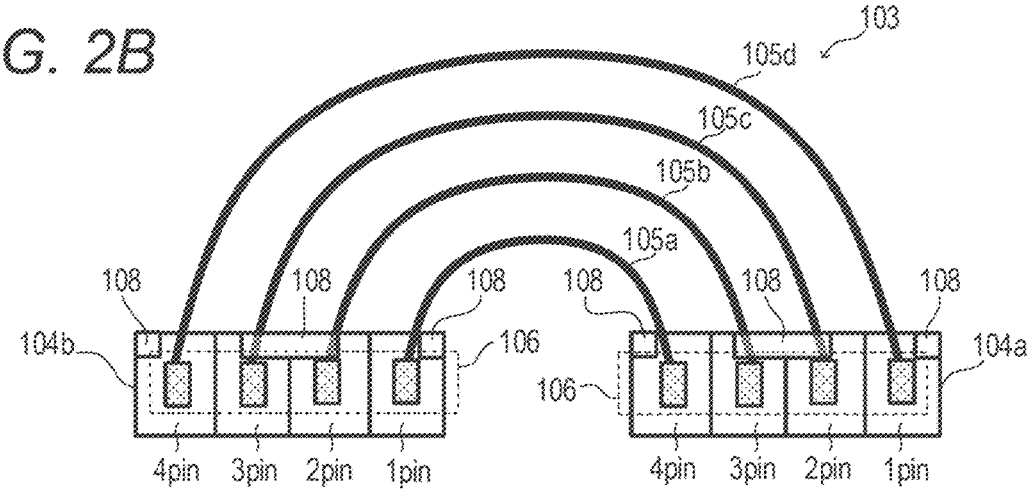
Figure 2C:
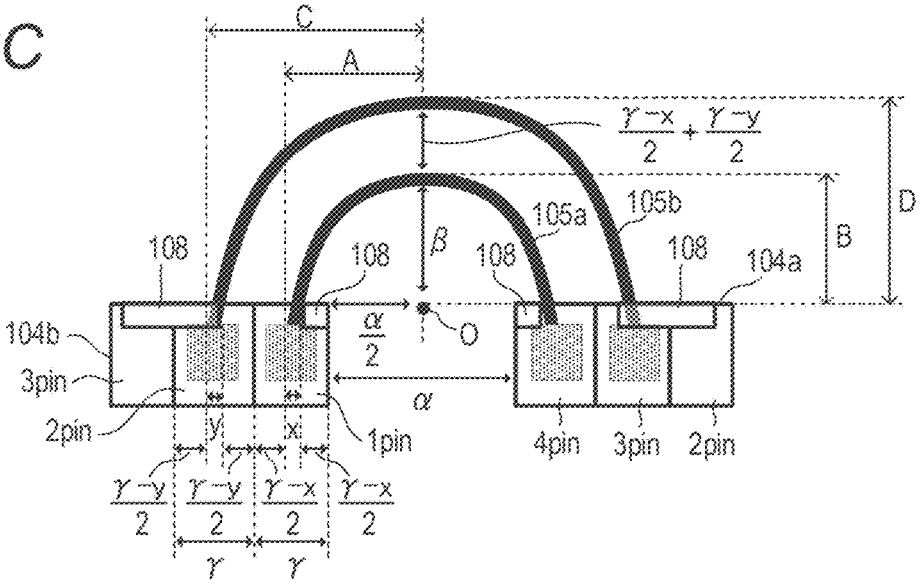

Circuit boards and an electric wire bundle according to the first embodiment will be described below with reference to FIGS. 2A, 2B and 2C. FIGS. 2A, 2B and 2C illustrate a first circuit board 102*a*, a second circuit board 102*b*, and an electric wire bundle 103 according to the first embodiment. The heater 26 in the fixing device 16 is connected to an AC power source 110 via an AC circuit board (hereinafter referred to as first circuit board) 102*a* including a control circuit including a switching element, such as a triac. The AC power source 110 is an AC commercial power source. AC voltage is applied from the AC power source 110 to the heater 26 in the fixing device 16 via the first circuit board 102*a*. The first circuit board 102*a* is electrically connected to a power source circuit board (hereinafter referred to as second circuit board) 102*b* via the electric wire bundle 103. As described above, the AC voltage from the AC power source 110 is temporarily supplied to the first circuit board 102*a*. The AC voltage is therefore supplied from the AC power source 110 to the second circuit board 102*b* via the first circuit board 102*a*. The second circuit board 102*b* converts the AC voltage supplied from the AC power source 110 into low DC voltage. The second circuit board 102*b* produces, for example, 3.3-V DC voltage, 12-V DC voltage, and 24-V DC voltage from 100-V AC voltage. The DC voltage produced by the second circuit board 102*b* are supplied to the first circuit board 102*a* again via the electric wire bundle 103 and distributed to a load 111, such as the image forming portions 1, the controller, and the motors, via a distribution circuit in the first circuit board 102*a*.

Figure 4A:
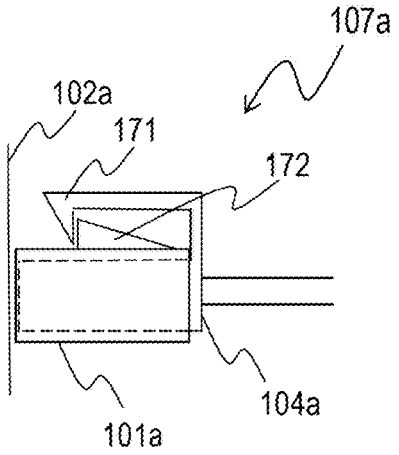
FIGS. 4A and 4B illustrate a lock mechanism.
Figure 4B:
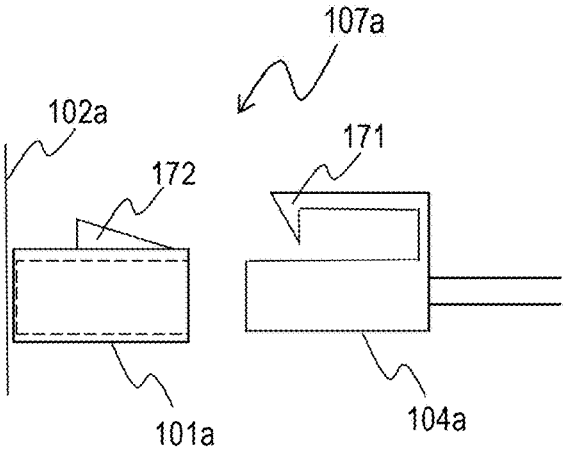
Figure 5A:
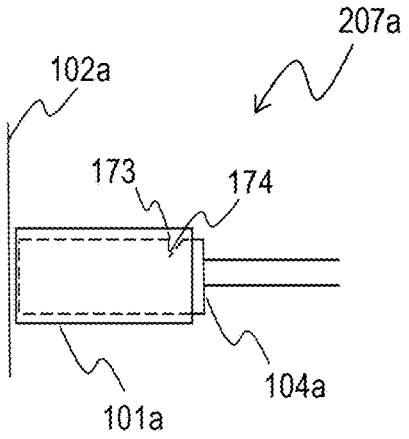
FIGS. 5A and 5B illustrate another configuration of a lock mechanism.
Figure 5B:
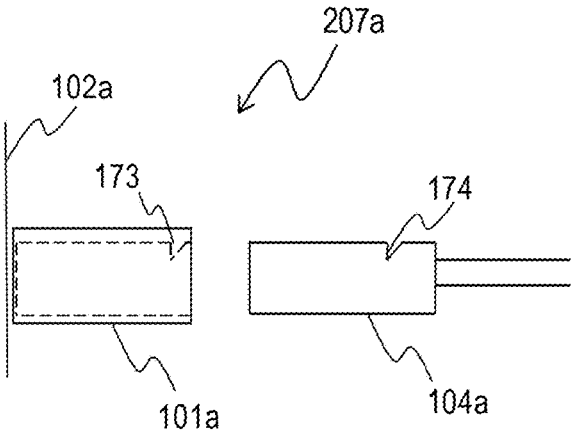

A first connector 101*a* mounted on the first circuit board 102*a* and a second connector 101*b* mounted on the second circuit board 102*b* are horizontally arranged side by side, as illustrated in FIG. 2A. The first connector 101*a* and the second connector 101*b* are each a connector for power source. The first connector 101*a* and the second connector 101*b* may each be a single connector or may be a double connector. A lock mechanism 107*a* will now be described in detail with reference to FIGS. 4A and 4B. The lock mechanism 107*a* includes an engaging portion 171, which engages with a hook 172, of a first connector housing 104*a*. When the first connector housing 104*a* is inserted into the first connector 101*a*, the hook 172 engages with the engaging portion 171. Therefore, when the first connector housing 104*a* is connected to the first connector 101*a*, a plurality of pins of the first connector housing 104*a* come into contact with a plurality of pins of the first connector 101*a* to be a conductive state. A lock mechanism 207*a*, which has a configuration different from the configuration of the lock mechanism 107*a*, will be described with reference to FIGS. 5A and 5B. The lock mechanism 207*a* includes a hook 173, which engages with an engaging portion 174 of the first connector housing 104*a*. That is, the hook 173 and the engaging portion 174 of the lock mechanism 207*a* illustrated in FIGS. 5A and 5B and the hook 172 and the engaging portion 171 of the lock mechanism 107*a* illustrated in FIGS. 4A and 4B have a reversed relationship. The description of FIG. 2A resumes. The first lock mechanism 107*a* for the first connector 101*a* has the same orientation as the orientation of the second lock mechanism 107*b* for the second connector 101*b*. The first lock mechanism 107*a* and the second lock mechanism 107*b* are each, for example, a snap fit that couples the first connector 101*a* and the second connector 10*b* to the first connector housing 104*a* and the second connector housing 104*b*. The first connector housing 104*a* is connected to a first end portion (one-end portion) 103*a* of the electric wire bundle 103. The first connector housing 104*a* is detachably attached to the first connector 101*a*. The first lock mechanism 107*a* locks the first connector housing 104*a* to the first connector 101*a* to prevent the first connector housing 104*a* from being disconnected from the first connector 101*a*. The second connector housing 104*b* is connected to a second end portion (the other-end portion) 103*b* of the electric wire bundle 103. The second connector housing 104*b* is detachably attached to the second connector 101*b*. The second lock mechanism 107*b* locks the second connector housing 104*b* to the second connector 101*b* to prevent the second connector housing 104*b* from being disconnected from the second connector 101*b*.

FIG. 2B illustrates the electric wire bundle 103 with the first connector housing 104*a* and the second connector housing 104*b* connected to the opposite end portions of the electric wire bundle 103. The electric wire bundle 103 includes a plurality of electric wires 105*a*, 105*b*, 105*c* and 105*d*. In the first embodiment, the electric wire bundle 103 includes the four electric wires 105*a*, 105*b*, 105*c* and 105*d*, but the number of electric wires 105 is not limited to four. The number of electric wires 105 may be two or more. Insulating coatings are removed from opposite end portions of the plurality of electric wires 105*a*, 105*b*, 105*c* and 105*d*, and crimp terminals 106 are crimped to the opposite end portions of the electric wires 105. The crimp terminals 106 are inserted into a plurality of pins 1, 2, 3, and 4 of the first connector housing 104*a* and the second connector housing 104*b*. The number of pins of the first connector housing 104*a* and the second connector housing 104*b* is four in the first embodiment and may be two or more. The crimp terminals 106 are locked by lock mechanisms 108 provided at the pins 1, 2, 3, and 4 of the first connector housing 104*a* and the second connector housing 104*b*. The lock mechanisms 108 prevent the electric wires 105*a*, 105*b*, 105*c* and 105*d* from falling off the first connector housing 104*a* and the second connector housing 104*b*. The first connector housing 104*a* is connected to the first connector 101*a* on the first circuit board 102*a*. The second connector housing 104*b* is connected to the second connector 101*b* on the second circuit board 102*b*. The first circuit board 102*a* and the second circuit board 102*b* are thus electrically connected to each other via the electric wires 105*a*, 105*b*, 105*c* and 105*d*.

In general, the electric wire bundle 103 is so formed that the plurality of electric wires 105*a*, 105*b*, 105*c* and 105*d* connect the pins of the first connector housing 104*a* to the same-numbered pins of the second connector housing 104*b*. In the related-art connection, the pins 1, 2, 3 and 4 of the first connector housing 104*a* are connected to the pins 1, 2, 3 and 4 of the second connector housing 104*b*, respectively. In the connection in the first embodiment, however, the electric wire 105*d* connects the pin 1 of the first connector housing 104*a* to the pin 4 of the second connector housing 104*b*. The electric wire 105*c* connects the pin 2 of the first connector housing 104*a* to the pin 3 of the second connector housing 104*b*. The electric wire 105*b* connects the pin 3 of the first connector housing 104*a* to the pin 2 of the second connector housing 104*b*. The electric wire 105*a* connects the pin 4 of the first connector housing 104*a* to the pin 1 of the second connector housing 104*b*.

The plurality of electric wires 105 are so connected to the first connector housing 104*a* and the second connector housing 104*b* that the arrangement of the plurality of pins of the first connector housing 104*a* and the arrangement of the plurality of pins of the second connector housing 104*b* are switched. Further, the plurality of electric wires 105*a*, 105*b*, 105*c* and 105*d* have lengths different from one another. In the first embodiment, the electric wire 105*a* is shorter than the electric wire 105*b*, the electric wire 105*b* is shorter than the electric wire 105*c*, and the electric wire 105*c* is shorter than the electric wire 105*d* (105*a*<105*b*<105*c*<105*d*). Therefore, when the first connector housing 104*a* is detachably connected to the first connector 101*a*, and the second connector housing 104*b* is detachably connected to the second connector 101*b*, the plurality of electric wires 105 do not intersect each other. As a result, stress induced in the electric wires 105 and the crimp terminals 106 when the electric wires 105 intersect each other can be reduced.

FIG. 2C illustrates an example of how to specify the lengths of the electric wires 105. Let x be the diameter of the electric wire 105*a* and *y* be the diameter of the electric wire 105*b*. Let $\alpha$ be the distance between the first connector housing 104*a* and the second connector housing 104*b*. Let $\beta$ be the distance from the upper edges of the first connector housing 104*a* and the second connector housing 104*b* to the electric wire 105*a*. Let $\gamma$ be the width of each of the pins 1, 2, 3 and 4 of the first connector housing 104*a* and the second connector housing 104*b*. The position of the filled circle illustrated in FIG. 2C is called a reference point O.

The lateral distance A from the reference point O to the electric wire 105*a* is expressed by the following Formula 1:

$$\frac{\alpha}{2}+\frac{\gamma-x}{2}+x=A \quad \text{Formula 1}$$

The vertical distance B from the reference point O to the electric wire 105*a* is expressed by the following Formula 2:

$$X+\beta=B \quad \text{Formula 2}$$

When the distance A is greater than or equal to the distance B (A≥B), the length L of the electric wire 105*a* is expressed by the following Formula 3:

$$L=2A\int_0^{\frac{\pi}{2}}\sqrt{1-e^2\sin^2 t}dt \quad \text{Formula 3}$$

The lateral distance C from the reference point O to the electric wire 105*b* is expressed by the following Formula 4:

$$A+\frac{\gamma-x}{2}+\frac{\gamma-y}{2}+y=C \quad \text{Formula 4}$$

The vertical distance D from the reference point O to the electric wire 105*b* is expressed by the following Formula 5:

$$B+\frac{\gamma-x}{2}+\frac{\gamma-y}{2}+\gamma=D \quad \text{Formula 5}$$

When the distance C is greater than or equal to the distance D (C≥D), the length L' of the electric wire 105*b* is expressed by the following Formula 6:

$$L'=2C\int_0^{\frac{\pi}{2}}\sqrt{1-e^2\sin^2 t}dt \quad \text{Formula 6}$$

The distance α between the first connector housing 104*a* and the second connector housing 104*b* is assumed to be 50 mm (α=50 mm). The distance β from the upper edges of the first connector housing 104*a* and the second connector housing 104*b* to the electric wire 105*a* is assumed to be 20 mm (β=20 mm). The width γ of each of the pins 1, 2, 3 and 4 of the first connector housing 104*a* and the second connector housing 104*b* is assumed to be 5 mm (γ=5 mm). The diameter (outer diameter of coating) x of the electric wire 105*a* and the diameter (outer diameter of coating) y of the electric wire 105*b* are assumed to be 2 mm (x=y=2 mm). The outer diameter of the coating on each of the electric wires 105*c* and 105*d* are also both assumed to be 2 mm. In this case, calculation using Formulae 1 to 6 illustrates that the length L of the electric wire 105*a* is 80 mm (L=80 mm), the length L' of the electric wire 105*b* is 95 mm (L'=95 mm), the length of the electric wire 105*c* is 110 mm, and the length of the electric wire 105*d* is 126 mm.

Even in a case where the lengths described above are minimum dimensions of all the electric wires 105*a*, 105*b*, 105*c* and 105*d* and the minimum dimensions each have a tolerance ranging from +5 mm to +10 mm, the electric wires 105 do not intersect each other. Further, when the electric wires 105*a*, 105*b*, 105*c* and 105*d* are bundled with a bundling member, such as a TY-RAP (registered trademark), an INSULOK (registered trademark), a bundling band, and a tape, the electric wires 105 do not intersect each other as long as the following Formula 7 is satisfied:

$$\frac{\gamma-x}{2}+\frac{\gamma-y}{2}>0 \quad \text{Formula 7}$$

According to the first embodiment, differentiating the lengths of the plurality of electric wires 105 in the electric wire bundle 103 from one another can reduce stress induced in the plurality of electric wires 105. According to the first embodiment, the plurality of electric wires 105 are so disposed as not to intersect each other so that stress included in the plurality of electric wires 105 is reduced, whereby a situation in which the electric wires 105 intersect each other so that stress is induced in the electric wires 105 and the crimp terminals 106 provided at the electric wires 105 can be avoided. The first circuit board 102*a* is connected to the AC power source 110 to apply the AC voltage to the heater 26. The second circuit board 102*b* converts the AC voltage supplied from the AC power source 110 via the first circuit board 102*a* into the DC voltages. According to the first embodiment, stress induced in the plurality of electric wires 105 including the crimp terminals 106 and connecting the first circuit board 102*a* to the second circuit board 102*b* can be reduced.

Second Embodiment

Figure 3A:
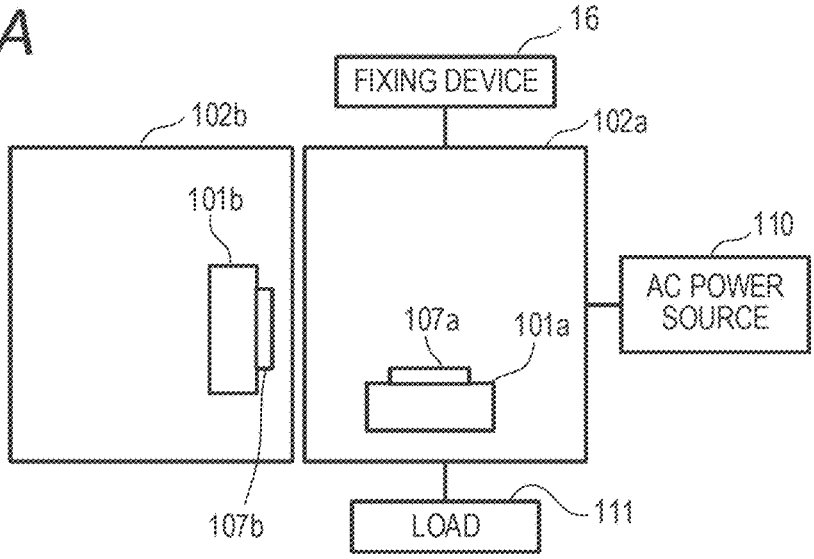
FIGS. 3A, 3B and 3C illustrate circuit boards and an electric wire bundle according to a second embodiment.

A second embodiment will be described below with reference to FIGS. 3A, 3B and 3C. In the second embodiment, the same structure as the structure in the first embodiment has the same reference character and will not be described. The image forming apparatus 100 and the image forming operation in the second embodiment are the same as the image forming apparatus 100 and the image forming operation in the first embodiment and will therefore not be described.

(Circuit Boards and Electric Wire Bundle)

Circuit boards and an electric wire bundle according to the second embodiment will be described below with reference to FIGS. 3A, 3B and 3C. FIGS. 3A, 3B and 3C illustrate the first circuit board 102*a*, the second circuit board 102*b*, and the electric wire bundle 103 according to the second embodiment. The first connector 101*a* mounted on the first circuit board 102*a* and the second connector 101*b* mounted on the second circuit board 102*b* are so disposed as to be perpendicular to each other, as illustrated in FIG. 3A. In FIG. 3A, the electric wire bundle 103 is not illustrated. The first lock mechanism 107*a* for the first connector 101*a* is oriented upward. The second lock mechanism 107*b* for the second connector 101*b* is oriented rightward.

Figure 3B:
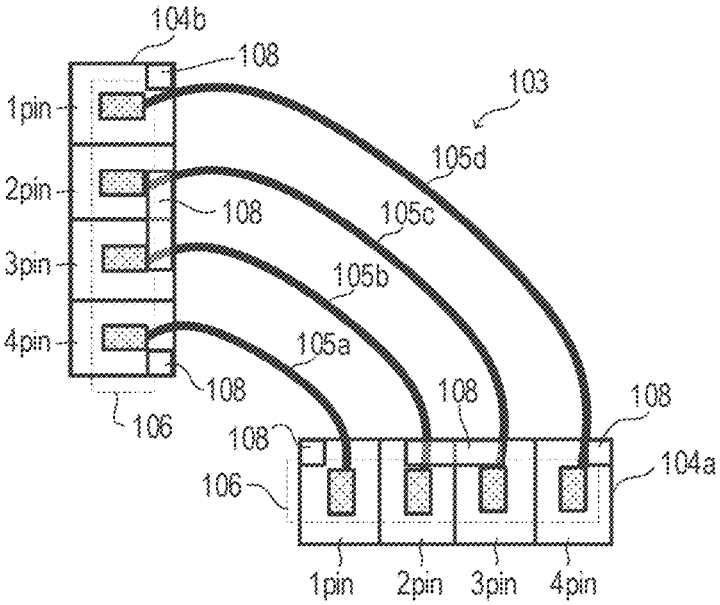

FIG. 3B is a top view of the electric wire bundle 103 in a case where the first connector housing 104*a* is connected to the first connector 101*a* and the second connector housing 104*b* is connected to the second connector 101*b*. In the second embodiment, the electric wire 105*a* connects the pin 1 of the first connector housing 104*a* to the pin 4 of the second connector housing 104*b*. The electric wire 105*b* connects the pin 2 of the first connector housing 104*a* to the pin 3 of the second connector housing 104*b*. The electric wire 105*c* connects the pin 3 of the first connector housing 104*a* to the pin 2 of the second connector housing 104*b*. The electric wire 105*d* connects the pin 4 of the first connector housing 104*a* to the pin 1 of the second connector housing 104*b*.

The plurality of electric wires 105*a*, 105*b*, 105*c* and 105*d* are so disposed in terms of the polarity in the first connector housing 104*a* and the second connector housing 104*b* as not to intersect each other. The plurality of electric wires 105*a*, 105*b*, 105*c* and 105*d* have lengths different from one another. In the second embodiment, the electric wire 105*a* is shorter than the electric wire 105*b*, the electric wire 105*b* is shorter than the electric wire 105*c*, and the electric wire 105*c* is shorter than the electric wire 105*d* (105*a*<105*b*<105*c*<105*d*). The configuration described above prevents the plurality of electric wires from intersecting each other.

Figure 3C:
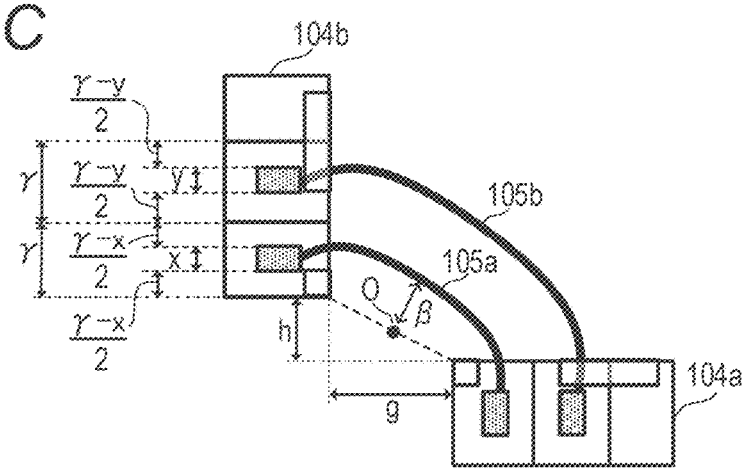

FIG. 3C illustrates an example of how to specify the lengths of the electric wires 105. Let x be the diameter of the electric wire 105*a* and *y* be the diameter of the electric wire 105*b*. Let g be the lateral distance between the first connector housing 104*a* and the second connector housing 104*b* and *h* be the vertical length therebetween. Let β be the distance from the upper edges of the first connector housing 104*a* and the second connector housing 104*b* to the electric wire 105*a*. Let γ be the width of each of the pins 1, 2, 3 and 4 of the first connector housing 104*a* and the second connector housing 104*b*. The position of the filled circle illustrated in FIG. 3C is called the reference point O.

The distance α between the first connector housing 104*a* and the second connector housing 104*b* is expressed by the following Formula 8:

$$\sqrt{g^2+h^2}=\alpha \qquad \text{Formula 8}$$

The other dimensions are calculated as follows with the distance α ensured: The lengths of the electric wires 105*a* and 105*b* are so calculated as to approximate the dimensions calculated in the case where the first connector housing 104*a* and second connector housing 104*b* are arranged side by side, as illustrated in FIG. 2C in the first embodiment.

The lateral distance A from the reference point O to the electric wire 105*a* is expressed with reference to FIG. 2C in the first embodiment by Formula 1 described above.

The vertical distance B from the reference point O to the electric wire 105*a* is expressed with reference to FIG. 2C in the first embodiment by Formula 2 described above.

When the distance A is greater than or equal to the distance B (A≥B), the length L of the electric wire 105*a* is expressed by Formula 3 described above.

The lateral distance C from the reference point O to the electric wire 105*b* is expressed with reference to FIG. 2C in the first embodiment by Formula 4 described above.

The vertical distance D from the reference point O to the electric wire 105*b* is expressed with reference to FIG. 2C in the first embodiment by Formula 5 described above.

When the distance C is greater than or equal to the distance D (C≥D), the length L' of the electric wire 105*b* is expressed by Formula 6 described above.

The lateral distance g between the first connector housing 104*a* and the second connector housing 104*b* is assumed to be 50 mm (g=50 mm). The vertical distance h between the first connector housing 104*a* and the second connector housing 104*b* is assumed to be 30 mm (h=30 mm). The distance β from the upper edges of the first connector housing 104*a* and the second connector housing 104*b* to the electric wire 105*a* is assumed to be 20 mm (β=20 mm). The width γ of each of the pins 1, 2, 3 and 4 of the first connector housing 104*a* and the second connector housing 104*b* is assumed to be 5 mm (γ=5 mm). The diameter (outer diameter of coating) x of the electric wire 105*a* and the diameter (outer diameter of coating) y of the electric wire 105*b* are assumed to be 2 mm (x=y=2 mm). The outer diameter of the coating on each of the electric wires 105*c* and 105*d* are also both assumed to be 2 mm. In this case, calculation using Formulae 1 to 6 and Formula 8 illustrates that the length L of the electric wire 105*a* is 90 mm (L=90 mm), the length L' of the electric wire 105*b* is 105 mm (L'=105 mm), the length of the electric wire 105*c* is 120 mm, and the length of the electric wire 105*d* is 135 mm.

Even in the case where the lengths described above are minimum dimensions of all the electric wires 105*a*, 105*b*, 105*c* and 105*d* and the minimum dimensions each have the tolerance ranging from +5 mm to +10 mm, the electric wires 105 do not intersect each other. When the electric wires 105*a*, 105*b*, 105*c* and 105*d* are bundled with a bundling member, the electric wires 105 do not intersect each other as long as the Formula 7 described above is satisfied, as in the first embodiment.

According to the second embodiment, differentiating the lengths of the plurality of electric wires 105 in the electric wire bundle 103 from one another can reduce stress induced in the plurality of electric wires 105. According to the second embodiment, the plurality of electric wires 105 are so disposed as not to intersect each other so that stress included in the plurality of electric wires 105 is reduced. The first circuit board 102*a* is connected to the AC power source 110 to apply the AC voltage to the heater 26. The second circuit board 102*b* converts the AC voltage supplied from the AC power source 110 via the first circuit board 102*a* into the DC voltages. According to the second embodiment, stress induced in the plurality of electric wires 105 including the crimp terminals 106 and connecting the first circuit board 102*a* to the second circuit board 102*b* can be reduced.

The first and second embodiments described above are applicable to a case where the number of pins of the first connector 101*a*, the second connector 101*b*, the first connector housing 104*a*, and the second connector housing 104*b* is two or more. In particular, when the number of pins is four or more, stress is likely to be induced in the electric wire bundle 103. Further, the first and second embodiments are applicable to the electric wires 105*a*, 105*b*, 105*c* and 105*d* having an outer diameter of the coatings greater than or equal to 1.8 mm.

As described above, in the image forming apparatus 100 according to each of the first and second embodiments, the pin arrangement of the first connector housing 104*a* and the pin arrangement of the second connector housing 104*b* are switched to differentiate the lengths of the electric wires 105*a*, 105*b*, 105*c* and 105*d* from one another. Stress induced in the electric wire bundle 103 can thus be reduced. An effect of avoiding deterioration in workability, falling off of the terminals, and other problems can thus be provided.

The first and second embodiments allow reduction in stress induced in a plurality of electric wires including crimp terminals for connecting a circuit board connected to an AC power source to apply AC voltage to a heater and a circuit board that converts the AC voltage supplied from the AC power source via the circuit board connected to the AC power source into DC voltage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-038242, filed Mar. 4, 2019, which is hereby incorporated by reference herein in its entirety.

What is claimed is:

1. An image forming apparatus, comprising:

an image forming unit configured to form an image on a sheet;

a heater configured to heat the image on the sheet to fix the image onto the sheet;

a first circuit board which is provided with a first connector including a plurality of pins, and configured to apply AC voltage supplied from a commercial power source to the heater;

a second circuit board which is provided with a second connector including a plurality of pins, and configured to convert the AC voltage into DC voltage to supply the DC voltage to the image forming unit;

a plurality of electric wires;

first crimp terminals which are provided with one-end portions of the plurality of electric wires;

second crimp terminals which are provided with other-end portions of the plurality of electric wires;

a first connector housing into which the first crimp terminals at the one-end portions are inserted, wherein the first connector housing and the first connector are detachably connecting; and a second connector housing into which the second crimp terminals at the other-end portions are inserted, wherein the second connector housing and the second connector are detachably connecting, wherein a longitudinal direction of the first connector on the first circuit board is parallel to a longitudinal direction of the second connector on the second circuit board, wherein a first pin among the plurality of pins of the first connector connects to a second pin among the plurality of pins of the second connector via a first electric wire among the plurality of electric wires, wherein a third pin among the plurality of pins of the first connector connects to a fourth pin among the plurality of pins of the second connector via a second electric wire among the plurality of electric wires, wherein a distance between the first pin and the second pin is farther than a distance between the third pin and the fourth pin, and wherein a length of the first electric wire is longer than a length of the second electric wire.

2. The image forming apparatus according to claim 1, wherein the first connector and the second connector are each a connector for power source.

3. The image forming apparatus according to claim 1, wherein the first connector includes a first lock mechanism which locks the first connector housing to the first connector to prevent the first connector housing from disconnecting from the first connector, and the second connector includes a second lock mechanism which locks the second connector housing to the second connector to prevent the second connector housing from disconnecting from the second connector.

4. The image forming apparatus according to claim 1, wherein the first connector and the second connector are each a single connector.

5. The image forming apparatus according to claim 1, wherein the first connector and the second connector are each a double connector.

6. The image forming apparatus according to claim 1, wherein the DC voltage is supplied to the image forming unit from the second circuit board via the first circuit board.

7. The image forming apparatus according to claim 1, further comprising a motor that is controlled by the first circuit board, wherein the DC voltage is supplied to the motor.

8. The image forming apparatus according to claim 1, further comprising a load of the image forming unit, wherein the DC voltage is supplied to the load of the image forming unit.

9. The image forming apparatus according to claim 1, wherein a fifth pin among the plurality of pins of the first connector connects to a sixth pin among the plurality of pins of the second connector via a third electric wire among the plurality of electric wires, wherein a distance between the fifth pin and the sixth pin is nearer than the distance between the third pin and the fourth pin, and wherein a length of the third electric wire is shorter than the length of the second electric wire.

10. An image forming apparatus, comprising:

an image forming unit configured to form an image on a sheet;

a heater configured to heat the image on the sheet to fix the image onto the sheet;

a first circuit board which is provided with a first connector including a plurality of pins, and configured to apply AC voltage supplied from a commercial power source to the heater;

a second circuit board which is provided with a second connector including a plurality of pins, and configured to convert the AC voltage into DC voltage to supply the DC voltage to the image forming unit;

a plurality of electric wires;

first crimp terminals which are provided with one-end portions of the plurality of electric wires;

second crimp terminals which are provided with other-end portions of the plurality of electric wires;

a first connector housing into which the first crimp terminals at the one-end portions are inserted, wherein the first connector housing and the first connector are detachably connecting; and a second connector housing into which the second crimp terminals at the other-end portions are inserted, wherein the second connector housing and the second connector are detachably connecting, wherein a longitudinal direction of the first connector on the first circuit board is orthogonal to a longitudinal direction of the second connector on the second circuit board, wherein a first pin among the plurality of pins of the first connector connects to a second pin among the plurality of pins of the second connector via a first electric wire among the plurality of electric wires, wherein a third pin among the plurality of pins of the first connector connects to a fourth pin among the plurality of pins of the second connector via a second electric wire among the plurality of electric wires, wherein a distance between the first pin and the second pin is farther than a distance between the third pin and the fourth pin, and wherein a length of the first electric wire is longer than a length of the second electric wire.

11. The image forming apparatus according to claim 10, wherein the first connector and the second connector are each a connector for power source.

12. The image forming apparatus according to claim 10, wherein the first connector includes a first lock mechanism which locks the first connector housing to the first connector to prevent the first connector housing from disconnecting from the first connector, and the second connector includes a second lock mechanism which locks the second connector housing to the second connector to prevent the second connector housing from disconnecting from the second connector.

13. The image forming apparatus according to claim 10, wherein the first connector and the second connector are each a single connector.

14. The image forming apparatus according to claim 10, wherein the first connector and the second connector are each a double connector.

15. The image forming apparatus according to claim 10, wherein the DC voltage is supplied to the image forming unit from the second circuit board via the first circuit board.

16. The image forming apparatus according to claim 10, further comprising a motor that is controlled by the first circuit board, wherein the DC voltage is supplied to the motor.

17. The image forming apparatus according to claim 10, further comprising a load of the image forming unit, wherein the DC voltage is supplied to the load of the image forming unit.

18. The image forming apparatus according to claim 10, wherein a fifth pin among the plurality of pins of the first connector connects to a sixth pin among the plurality of pins of the second connector via a third electric wire among the plurality of electric wires, wherein a distance between the fifth pin and the sixth pin is nearer than the distance between the third pin and the fourth pin, and wherein a length of the third electric wire is shorter than the length of the second electric wire.

* * * * *